US005413172A

United States Patent [19]

Laurel

[11] Patent Number: 5,413,172

[45] Date of Patent: May 9, 1995

[54] SUB-SURFACE RELEASE PLUG ASSEMBLY WITH NON-METALLIC COMPONENTS

[75] Inventor: David F. Laurel, Duncan, Okla.

[73] Assignee: Halliburton Company, Duncan, Okla.

[21] Appl. No.: 158,593

[22] Filed: Nov. 24, 1993

Related U.S. Application Data

[63] Continuation-in-part of Ser. No. 976,110, Nov. 16, 1992.

[51] Int. Cl.[6] ..... E21B 33/16

[52] U.S. Cl. ..... 166/153; 166/192

[58] Field of Search ..... 166/153, 155, 156, 291, 166/242, 192

[56] References Cited

U.S. PATENT DOCUMENTS

| | | | |
|---|---|---|---|
| 3,796,260 | 3/1974 | Bradley | 116/153 |
| 4,078,810 | 3/1978 | Arendt | 277/116.4 |
| 4,083,074 | 4/1978 | curtis | 15/104.06 R |
| 4,190,112 | 2/1980 | Davis | 166/291 |
| 4,356,865 | 11/1982 | Appel et al. | 166/153 |
| 4,457,369 | 7/1984 | Henderson | 166/125 |
| 4,624,312 | 11/1986 | McMullin | 166/155 |
| 4,753,444 | 6/1988 | Jackson et al. | 277/230 |
| 4,809,776 | 3/1989 | Bradley | 166/153 |
| 4,836,279 | 6/1989 | Freeman | 166/153 |
| 4,858,687 | 8/1989 | Watson et al. | 166/153 |
| 4,934,452 | 6/1990 | Bradley | 166/153 |
| 5,078,211 | 1/1992 | Swineford | 166/202 |
| 5,095,980 | 3/1992 | Watson | 166/192 |
| 5,224,540 | 7/1993 | Streich et al. | 166/118 |

OTHER PUBLICATIONS

Brochure from Rogers Corporation (Undated but admitted to be prior art).

Brochure from Occidental Chemical Corporation (Undated but amitted to be prior art).

Brochure from Fiberite Corporation (Apr. 1966).

*Primary Examiner*—Ramon S. Britts

*Assistant Examiner*—Frank S. Tsay

*Attorney, Agent, or Firm*—Stephen R. Christian; Neal R. Kennedy

[57] ABSTRACT

A sub-surface release plug assembly for use in cementing an outer casing annulus around a well casing. The plug assembly comprises non-metallic materials, and in particular, high-strength engineered plastics. A method of drilling out the plug assembly using a drill bit with no moving parts is also disclosed.

10 Claims, 7 Drawing Sheets

SUB-SURFACE RELEASE PLUG ASSEMBLY WITH NON-METALLIC COMPONENTS

This is a continuation-in-part of co-pending prior application Ser. No. 07/976,110 filed Nov. 16, 1992.

BACKGROUND OF THE INVENTION

1. Field Of The Invention

This invention relates to sub-surface release plugs used in cementing of the outer casing annulus of a wellbore, and more particularly, to a subsurface release plug assembly having high strength non-metallic components for allowing operation under relatively high pressures and temperatures and also allowing easy drilling thereof, such as with a polycrystalline diamond compact (PDC) drill bit.

2. Description Of The Prior Art

Typically, sub-surface release plugs positioned in the upper portion of a well casing below a casing hanger and attached to the lower end of a drill string are used in cementing operations for cementing a casing annulus adjacent a shoe joint. The construction and use of such plugs is disclosed in U.S. Pat. Nos. 4,809,776 and 4,934,452, both of which are assigned to the assignee of the present application, and both of which are hereby incorporated by reference. Another prior art sub-surface release plug assembly is disclosed in Halliburton Services Sales & Service Catalog No. 43, pages 2424–2426.

Typically, a bottom plug of the assembly is released, and cement in pumped into the casing above the bottom plug, forcing the bottom plug downwardly until it comes to rest at the upper end of the shoe joint. The bottom plug seals against the inner surface of the casing so that mud below the bottom plug and cement above the bottom plug are not mixed. Once the bottom plug has reached its lowermost position, a passageway in the bottom plug is opened to allow cement to pass therethrough. The cement then passes through a float collar and/or float shoe and an opening at the lower end of the shoe joint in the casing annulus. A valve in the float collar and/or float shoe prevents reverse movement of the cement through the casing.

When the proper amount of cement has been introduced into the casing and drill string, a releasing dart or drill pipe plug is dropped into the drill string. The releasing dart engages a latching mechanism above the top plug, thus closing off the central opening of the top plug and releasing it from the drill string. The fluid pumped into the drill string forces the top plug, and the dart or drill pipe plug latched thereto, down toward the bottom plug, forcing the cement through the shoe joint. The top plug stops when it contacts the bottom plug.

Once the cement has set, the top and bottom plugs are drilled out of the casing. Mating teeth on the upper and lower plugs prevent relative rotation therebetween so the top plug does not merely rotate when contacted by a drill bit. Most prior art sub-surface plug assemblies use metallic components, and the drill bits used to drill the components out of the casing must be adapted for cutting such materials. Typically, standard "tri-cone" rotary drill bits are used with appropriate loading applied thereto. Such prior drillable devices have worked well, but drilling out iron components requires certain techniques. Ideally, the operator employs variations in rotary speed and bit weight to help break up the metal parts and reestablish bit penetration should bit penetration cease while drilling. A phenomenon known as "bit tracking" can occur, where the drill bit stays on one path and no longer cuts into the plug assembly. When this happens, it is necessary to pick up the bit above the drilling surface and rapidly recontact the bit with the plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the plug rather than cutting into it to break it up.

While metallic components, such as cast iron, may be necessary for some pressures and temperatures, many wells experience less severe conditions. This includes most wells cemented. Thus, the heavy-duty metal construction of previous sub-surface plug assemblies is not necessary for many applications, and if cast-iron components can be eliminated or minimized, the potential drilling problems resulting from bit tracking might be avoided as well.

The sub-surface release plug of the present invention solves this problem by providing an apparatus wherein at least some of the components are made of non-metallic materials, and in particular, high strength plastic. Molding of the plastic plugs also eliminates some of the machining necessary on metallic components. Such plastic components are more easily drilled than cast iron, and new drilling methods may be employed which use alternative drill bits, such as polycrystalline diamond compact (PDC) bits, or the like, rather than standard tri-cone bits.

Sub-surface release plugs have been made of non-metallic materials, such as plastic, and the drilling problems associated with plug assemblies using metallic components avoided because the plastic is easier to drill. However, the use of such plastic plugs have been limited in the past to relatively low pressure and temperature conditions in the well casing. Prior art sub-surface release plug assemblies utilizing plastic components have been limited to pressures in the range of about 3,500 to about 5,000 psi and also limited to maximum temperatures of about 300° F. The present invention improves on these prior art subsurface release plug assemblies by utilizing a high strength plastic material which allows pressure up to about 10,000 psi and temperatures in the range of about 300° F. to about 400° F. Of course, the plastic materials used in the present invention may also be used at temperatures and pressures below these levels.

SUMMARY OF THE INVENTION

The present invention includes a sub-surface release plug apparatus comprising a body made of a high strength, non-metallic material. Preferably, this material is a high strength plastic.

In a particularly preferred embodiment the plastic is a glass-filled phenolic. The physical properties of the plastic include a compressive strength of at least 35,000 psi using ASTM Test Method D695 and a deflection temperature of 400° F. using ASTM Test Method D648.

The plug preferably also comprises a plurality of flexible wipers extending outwardly and upwardly from the body. The wipers may be a portion of an elastomeric jacket substantially surrounding and bonded to the body.

The plug may be described as an upper plug, and the apparatus may further comprise a lower plug releasably attached to the upper plug. The lower plug comprises a body preferably made of the same non-metallic material as the body of the upper plug.

The lower plug is releasable from the upper plug by engagement of a releasing ball therewith. The ball may be made of a non-metallic material, such as plastic.

The upper plug is releasable from the end of a drill string by engagement of a releasing plug with the upper plug. Preferably, the releasing plug comprises a body made of a high strength plastic, such as that for the bodies of the upper and lower plugs. The releasing plug may further comprise an elastomeric jacket substantially surrounding and bonded to the body of the releasing plug. The jacket comprises a plurality of wiper rings extending outwardly therefrom.

The present invention also includes a method of cementing a well. This method comprises the steps of providing a sub-surface release plug assembly in a well casing and releasably attaching the plug assembly to a drill string, releasing the plug assembly and pumping cement through the well casing until the plug assembly engages a float shoe at a lower end of the well casing, pressure testing the well casing, and drilling out the plug assembly. The sub-surface plug assembly comprises high strength plastic components.

The step of pressurizing the well casing comprises raising the pressure in the well casing to approximately 10,000 psi. Preferably this step of pressurizing is carried out at a temperature in the range of about 300° F. to about 400° F.

The step of drilling may be carried out using a polycrystalline diamond compact drill bit, although other types of drill bits could also be used.

Numerous objects and advantages of the invention will become apparent as the following detailed description of the preferred embodiment is read in conjunction with drawings which illustrate such preferred embodiment.

BRIEF DESCRIPTION OF THE DRAWINGS

FIG. 6 illustrates a longitudinal cross section of the lower plug at the bottom of the well casing and with a flow valve therein in an open position.

FIGS, 7A and 7B show a longitudinal cross section of the sub-surface release plug assembly after release of the upper plug wherein the top plug is engaged with the bottom plug at the lower end of the well casing.

Figure 8:
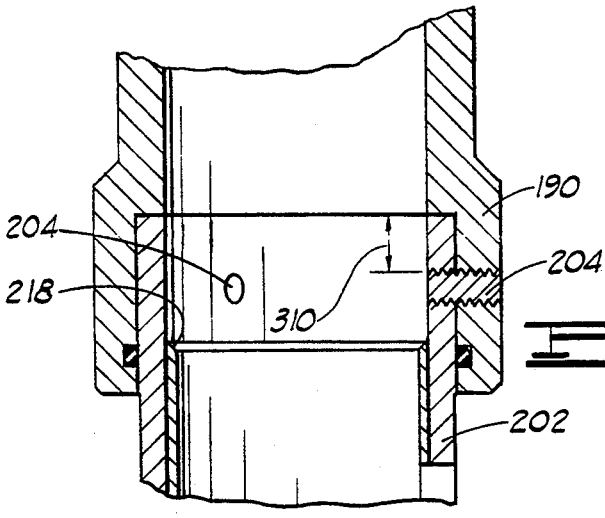

FIG. 8 shows a longitudinal cross section of the bottom plug release mechanism.

Figure 9:
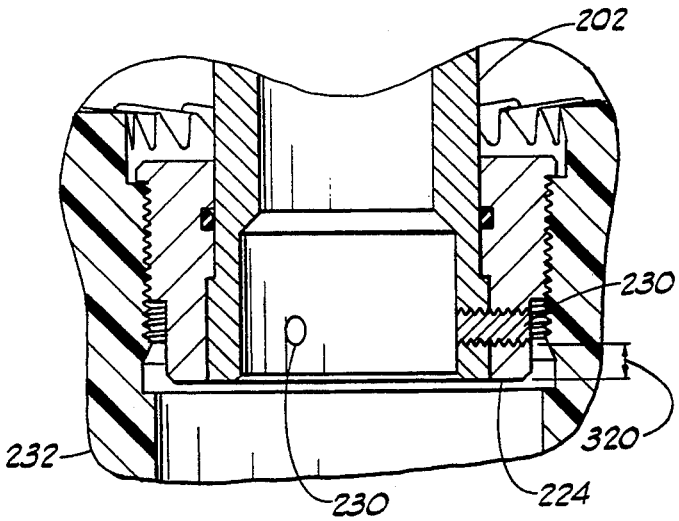

FIG. 9 shows a longitudinal cross section of the release mechanism with a valve means disposed in the cement passageway in the lower plug.

Figure 10:
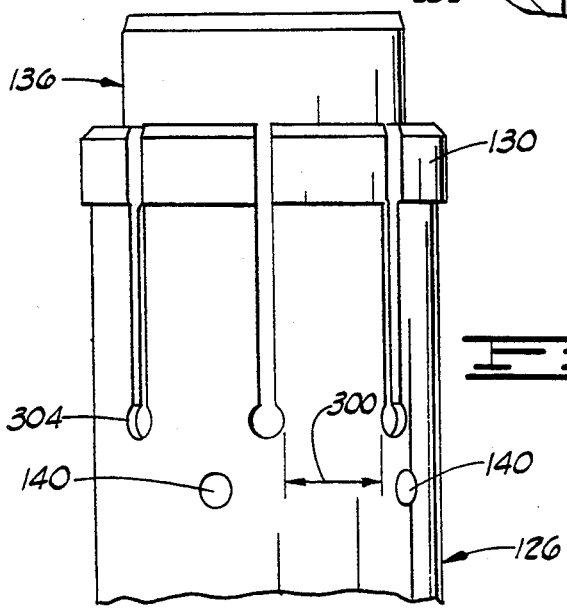

FIG. 10 shows an enlarged view of the collet release mechanism of the present invention.

Figure 11:
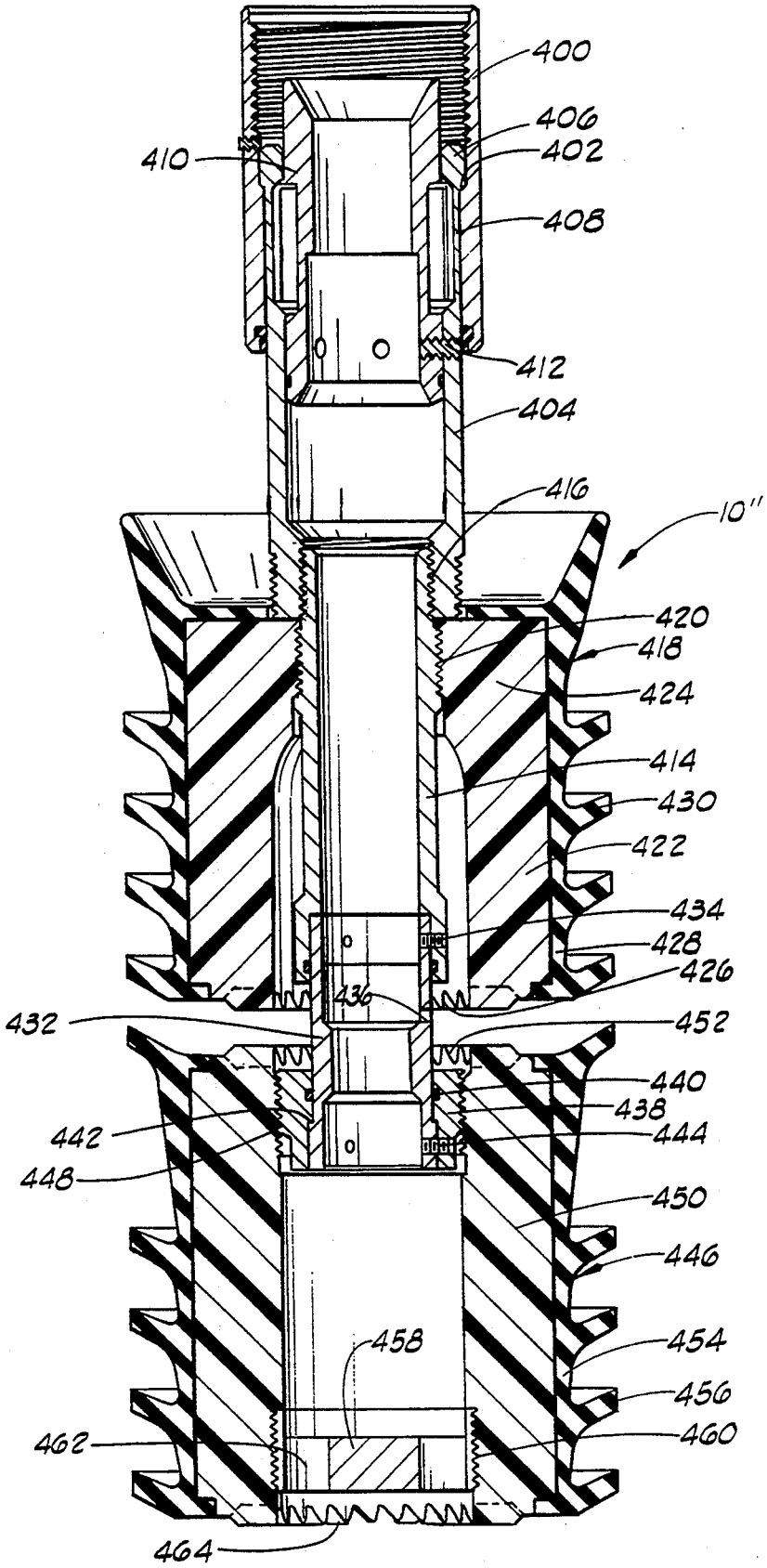

FIG. 11 generally illustrates the sub-surface release plug of the present invention after it has been released and showing a drill bit disposed thereabove for drilling the assembly out of the casing.

Figure 12:
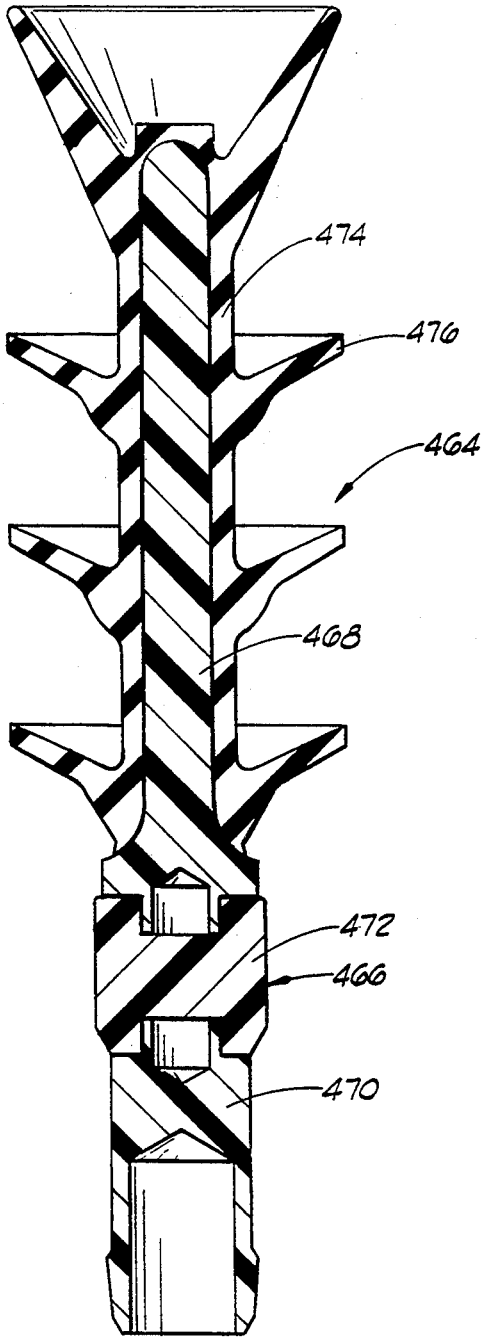

FIG. 12 illustrates a longitudinal cross section of a releasing dart having components made of non-metallic materials.

Figure 13:
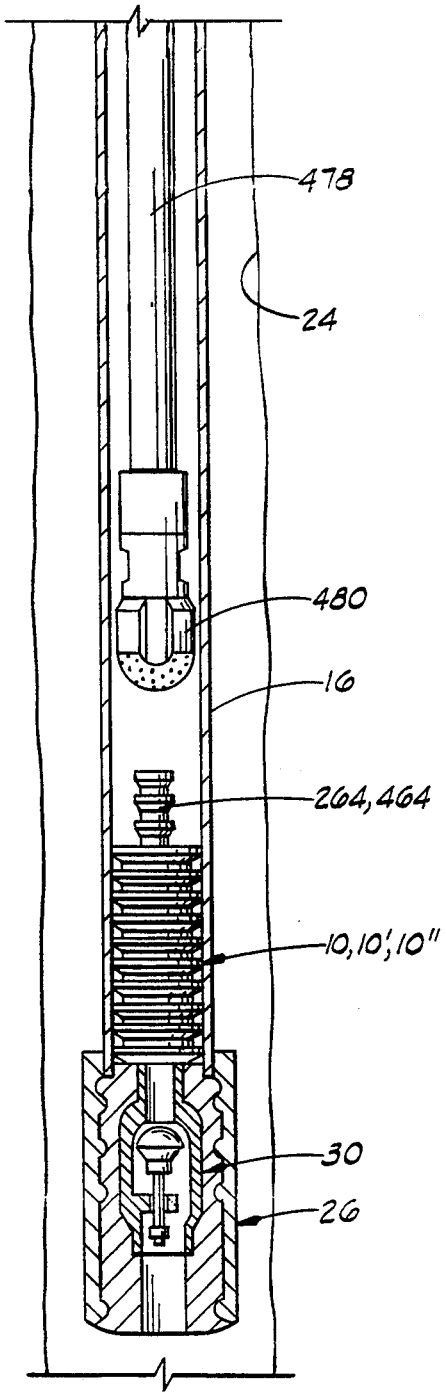

FIG. 13 illustrates the sub-surface release plug of the present invention in its final position engaged with the top of a float shoe and showing a drill bit positioned thereabove.

DESCRIPTION OF THE PREFERRED EMBODIMENT

Figure 1:
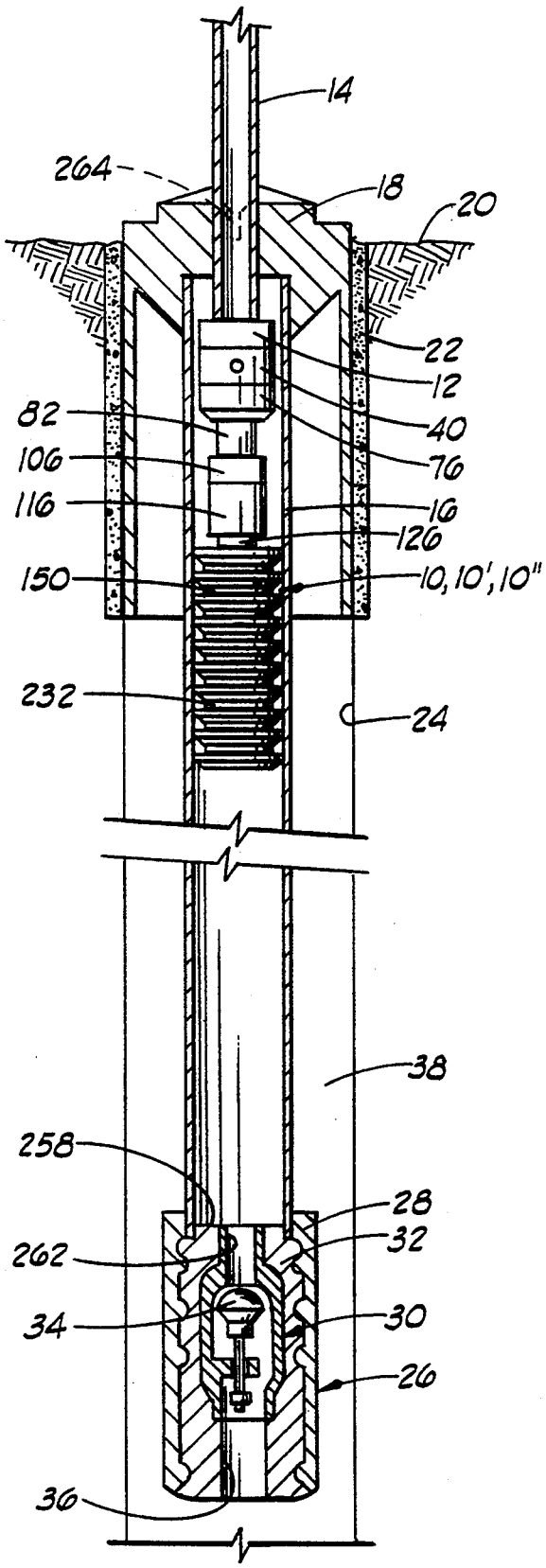
FIG. 1 shows the sub-surface release plug assembly of the present invention installed in its initial position in a well casing.

Referring now to the drawings, and more particularly to FIG. 1, a first embodiment of the sub-surface release plug assembly of the present invention is shown and generally designated by the numeral 10. FIG. 1 also may be used to illustrate second embodiment 10' and third embodiment 10'' which will be discussed in more detail herein. Sub-surface release plug assembly 10, 10' or 10'' has an upper adapter 12, connectable to the lower end of a drill string 14, and is positioned in a well casing 16. Well casing 16 is supported by a casing hanger or subsea wellhead 18 at sea floor 20. An annular concrete foundation 22 holds casing hanger 18 in place in wellbore 24.

Typically attached to the lower end of well casing 16 is a float shoe 26. Float shoe 26 has an outer sleeve 28 and a check valve assembly 30 held in place by a cement portion 32. Check valve assembly 30 includes a back pressure valve 34 therein.

Float shoe 26 defines a lower opening 36 therein which opens into outer casing annulus 38 between well casing 16 and wellbore 24.

Float shoe 26 is of a kind known in the art, and in one alternate embodiment also known in the art, a float collar or other similar device at the upper end of a shoe joint could be used. In still another embodiment, a guide shoe having a free flow, fully open and substantially unobstructed central opening therethrough but no float collar assembly 30 could be used. Sub-surface release plug assembly 10 may be used with any of these devices, and the invention is not intended to be limited for use with a float shoe illustrated.

Figure 2A:
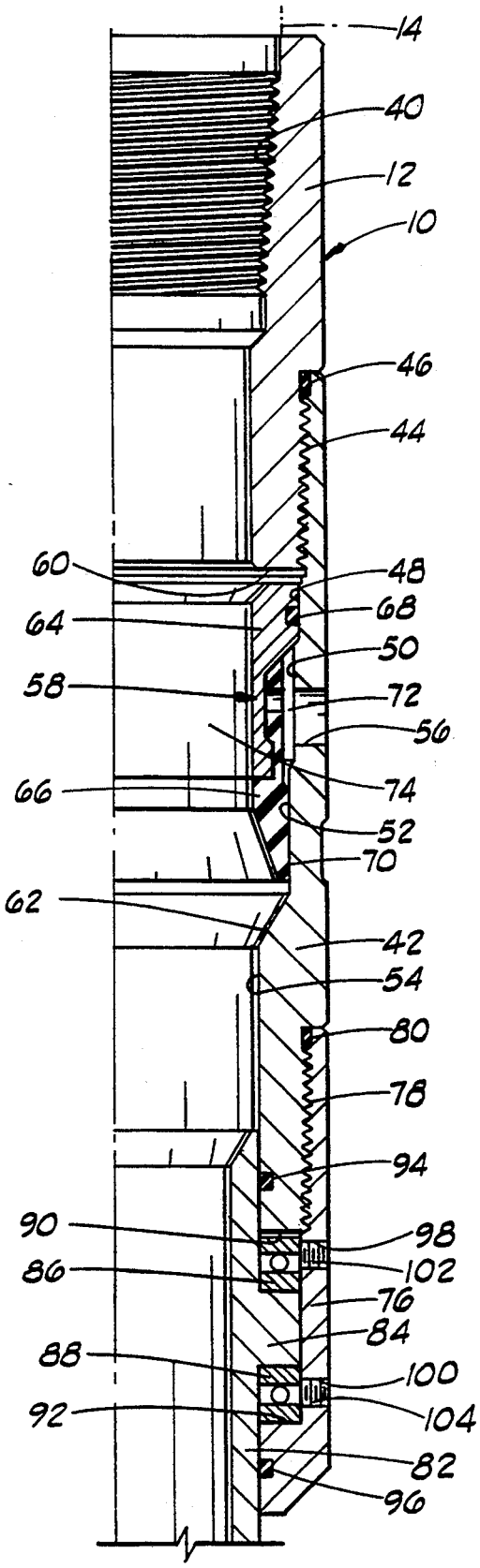
FIGS. 2A–2C show a longitudinal cross section of the sub-surface release plug in its initial position prior to release of any components thereof.
Figure 2B:
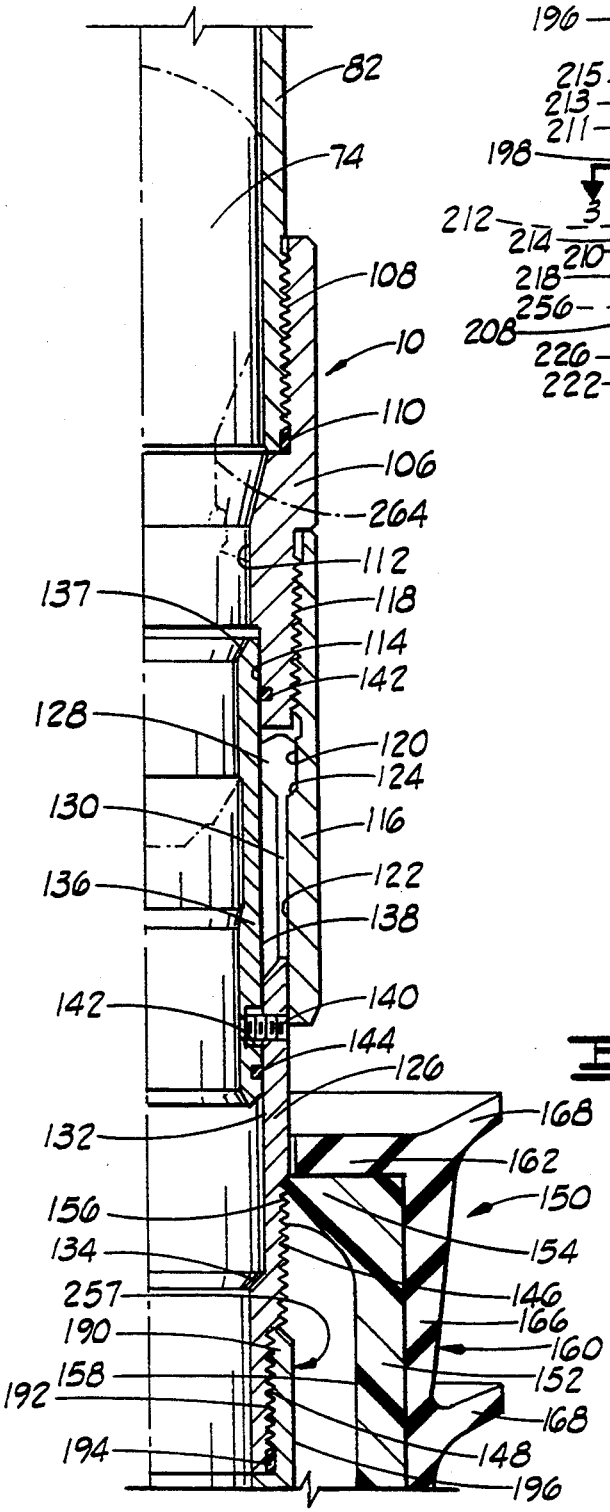
Figure 2C:
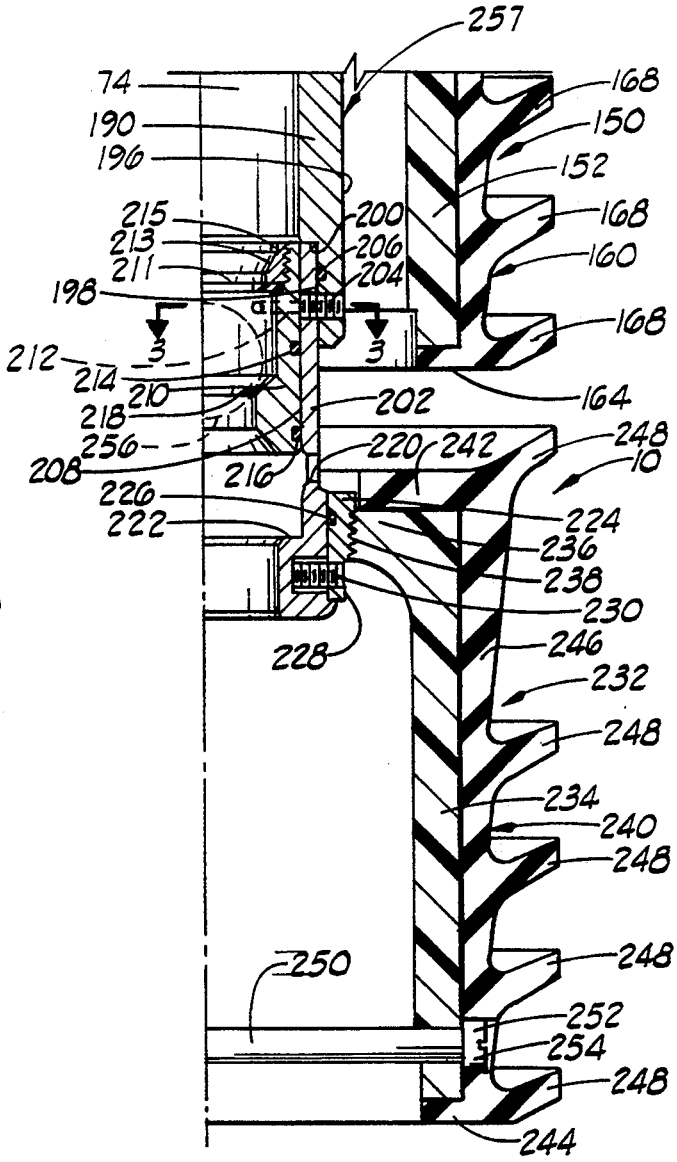

Referring now to FIGS. 2A–2C, details of first embodiment sub-surface release plug assembly 10 will now be discussed.

As shown in FIG. 2A, the upper end of upper adapter 12 has a threaded opening 40 therein adapted for attachment to drill string 14. The lower end of upper adapter 12 is connected to equalizer case 42 at threaded connection 44. Sealing means 46, such as an 0-ring, provides sealing engagement between upper adapter 12 and equalizer case 42.

Equalizer case 42 defines a first bore 48, second bore 50, third bore 52 and fourth bore 54 therethrough. Equalizer case 42 also defines a transverse vent or equalizer opening 56 therethrough in communication with second bore 50.

A check valve means 58 is positioned in equalizer case 42 at a longitudinal location between lower end 60 of upper adapter 12 and chamfer 62 in equalizer case 42 between third bore 52 and fourth bore 54 thereof. Check valve means 58 includes a valve body 64 and a valve seal 66, made of an elastomeric material such as rubber. A sealing means 68, such as an O-ring, provides sealing engagement between valve body 64 and first bore 48 of equalizer case 42. A sealing lip 70 on valve seal 66 provides sealing engagement between the valve seal and third bore 52 of equalizer case 42. Thus, it will be seen that an annular volume 72 is defined between sealing means 58 and equalizer case 42 and is in communication with vent opening 56. It will also be seen that vent opening 56 is thus sealingly separated from central opening 74 through sub-surface release plug assembly 10. Thus, a vent means is provided wherein venting is allowed from well casing 16 to drill string 14 while venting from the drill string to the well casing is prevented.

The lower end of equalizer case 42 is attached to bearing housing 76 at threaded connection 78 with sealing means 80 providing sealing engagement therebetween.

Rotatably disposed within bearing housing 76 is the upper end of a swivel mandrel 82. Swivel mandrel 82 has a radially outwardly extending shoulder portion 84 thereon which is rotatably supported by upper ball bearing 86 and lower ball bearing 88 between lower end 90 of equalizer case 42 and upwardly facing shoulder 92 and bearing housing 76. Thus, assembly 10 includes swivel means for providing relative rotation between drill string 14 and the components below swivel mandrel 82.

Sealing means 94 provides sealing engagement between swivel mandrel 82 and fourth bore 54 of equalizer case 42 above bearings 86 and 88, and sealing means 96 provides sealing engagement between the swivel mandrel and bearing housing 76 below the bearings.

Bearing housing 76 defines a transverse hole 98 therethrough adjacent upper bearing 86 and a similar transverse hole 100 therethrough adjacent lower bearing 88. Holes 98 and 100 provide means for greasing bearings 86 and 88, respectively. Although holes 98 and 100 are shown in the same longitudinal plane in FIG. 2A, the holes are preferably angularly spaced 180° from one another. After greasing bearings 86 and 88, pipe plugs 102 and 104 are used to sealingly close holes 98 and 100, respectively.

Referring now to FIG. 2B, the lower end of swivel mandrel 82 is attached to the upper end of a lower connector 106 at threaded connection 108. Seal means 110 provides sealing engagement between swivel mandrel 82 and lower connector 106. Lower connector 106 defines a first bore 112 and a second bore 114 therethrough.

The lower end of lower connector 106 is connected to collet retainer 116 at threaded connection 118. Collet retainer 116 defines a first bore 120 and a second bore 122 therethrough with an annular, chamfered shoulder 124 therebetween.

The upper end of collet retainer 126 is disposed in collet retainer 116 below lower connector 16 such that the head portions 128 of a plurality of collet fingers engage shoulder 124 in collet retainer 116.

Collet 126 defines a bore 132 therethrough and has a generally upwardly facing shoulder 134 at the lower end of bore 132.

A releasing sleeve 136 is disposed in, and has an outer surface 138 in close spaced relationship with, second bore 114 of lower connector 106 and bore 132 of collet 126. It will also be seen that in the original position shown in FIG. 2B, releasing sleeve 136 keeps head portions 128 of collet fingers 130 engaged with shoulder 124 in collet retainer 116.

A shear means 140, such as a shear pin, is engaged with collet 126 and extends into a recess 142 in releasing sleeve 136, thus releasably holding the releasing sleeve in the original position shown in FIG. 2B.

Seal means 142 provides sealing engagement between lower connector 106 and the upper end of releasing sleeve 136 above collet fingers 130. Similarly, seal means 144 provides sealing engagement between bore 132 of collet 126 and releasing sleeve 136 below collet fingers 130. Thus, prior to actuation of releasing sleeve 136, means are provided in the illustrated embodiment for preventing communication between collet fingers 130 and central opening 74 of sub-surface release plug assembly 10. This insures that cement and other fluids in drill string 14 do not interfere with the proper operation of collet fingers 130. However, it should be understood that the present invention is not intended to be limited to this particular collet configuration or to collet fingers which are initially isolated from drill string 14.

An intermediate portion of collet 126 has a first external thread 146 thereon, and the lower end of collet 126 has a second external thread 148 thereon. Preferably, second external thread 148 is smaller than first external thread 146.

A first or upper plug means 150, also referred to as a top plug means 150, is attached to collet 126 as shown in FIG. 2B, and, also referring to FIG. 2C, extends downwardly from the collet. Upper plug means 150 has a body or insert 152 with an upper, inwardly directed portion 154 which forms a threaded connection 156 with first external thread 146 of collet 126.

Body or insert 152 is made of a non-metallic material, such as a high-strength plastic. In manufacturing, insert 152 may be molded of the high-strength plastic and then some of the surfaces subsequently machined if necessary. In a preferred embodiment, the high-strength plastic is a glass-filled phenolic material with good dimensional stability. Preferred physical properties include a compressive strength of at least 35,000 psi (ASTM D695) and a deflection temperature of at least 400° F. (ASTM D648).

When insert 152 is made of this material, the assembly is capable of withstanding high casing pressures above upper plug means 150 and relatively high temperatures. The strength of this material allows pressure testing of the well casing immediately after the sub-surface release plugs land on the float collar or float shoe. The release operation is described in more detail hereinafter. Such casing pressures may be as high as approximately 10,000 psi. The material also allows operation in a temperature range of about 300° F. to about 400° F., as opposed to prior art sub-surface release plugs using plastic components which have maximum temperature limitations of about 300° F. The prior art plastic plugs were also limited to pressures up to about 5,000 psi, and were normally used in the range of about 3,500 psi to about 5,000 psi.

Insert 152 of upper plug means 150 is substantially surrounded by a jacket 160 bonded to the insert and preferably made of elastomeric material. Jacket 160 has an upper, inwardly directed portion 162 adjacent upper portion 154 of insert 152 and an inwardly directed lower portion 164 adjacent the lower end of insert 152. A generally longitudinal portion 166 of jacket 160 interconnects upper portion 162 and lower portion 164 thereof. Extending outwardly and angularly upwardly from longitudinal portion 166 are a plurality of wipers 168. As will be more fully explained herein, wipers 168 are adapted for sealingly engaging the inner surface of well casing 16.

Figure 4:
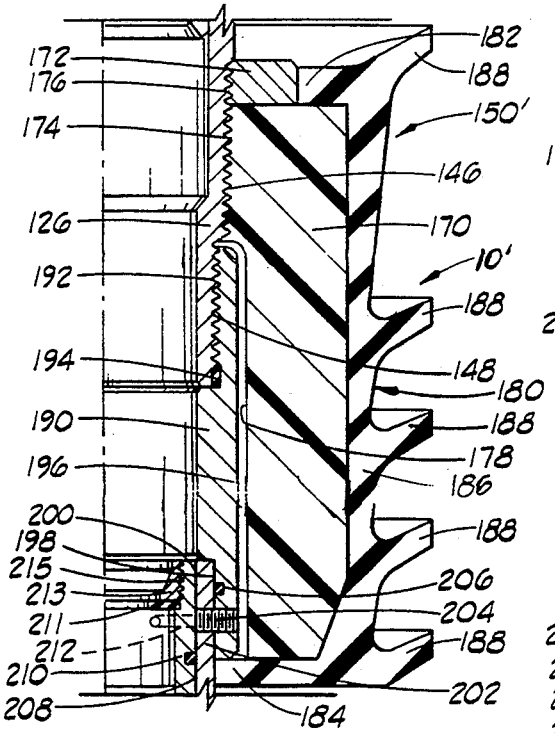
FIG. 4 is a longitudinal cross section of an alternate embodiment of the top plug of the sub-surface release plug assembly.

Referring now to FIG. 4, a second embodiment plug assembly is shown and has an alternate first or upper plug means 150' is shown attached to collet 126. Upper plug means 150' includes a body or insert 170, made of a high-strength plastic, such as that previously mentioned with regard to insert 152. A support ring 172 may be positioned above insert 170. Support ring 172 may be made of a metallic material, such as aluminum, but the invention is not intended to be limited to this particular material.

Insert 170 forms a threaded connection 174 with external thread 146 of collet 126, and support ring 172 forms a threaded connection 176 with external thread 146.

Insert 170 is very similar to insert 152, but insert 170 has a substantially cylindrical inside surface 178 which is relatively smaller than inside surface 158 of insert 152 in first embodiment 10. This thicker wall section of insert 170 increases the strength of the part.

As with first embodiment 10, a jacket 180, preferably made of an elastomeric material, substantially surrounds and is bonded to insert 170. Jacket 180 has an upper, inwardly directed portion 182 adjacent the upper end of insert 170 and the outside diameter of support ring 172. An inwardly directed, lower portion of jacket 180 is positioned adjacent the lower end of insert 170. A longitudinal portion 186 of jacket 180 extends between upper portion 182 and lower portion 184 thereof. As with first embodiment 10, a plurality of wipers 188 extend angularly upwardly and outwardly from longitudinal portion 186. Again, wipers 188 are adapted for sealing engagement with the inside surface of well casing 16.

For either upper plug means 150 or 150', the lower end of collet 126 is attached to a collet connector 190 at threaded connection 192 formed with external thread 148 on collet 126. Sealing means 194 provides sealing engagement between collet 126 and collet connector 190. It will be seen that outer surface 196 is closer to inside diameter 178 of insert 170 in second embodiment upper plug means 150' than inside surface 158 of insert 152 in first embodiment upper plug means 150.

Referring now to FIGS. 2C and 4, the lower end of collet connector 190 defines a bore 198 with a downwardly facing shoulder 200 adjacent thereto. Slidably positioned in bore 198 and adjacent shoulder 200 is a vent sleeve 202. Vent sleeve 202 is releasably attached to collet connector 190 by shear means 204, such as a shear pin. Shear means 206 provides sealing engagement between vent sleeve 202 and bore 198 in collet connector 190.

Figure 3:
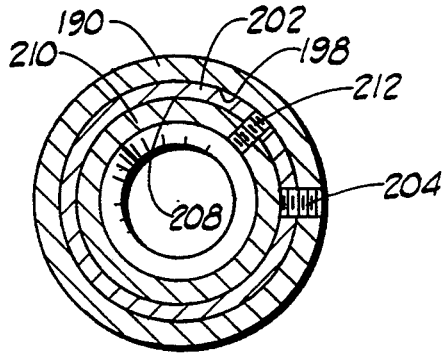
FIG. 3 is a transverse cross section taken along lines 3–3 in FIG. 2C.

Vent sleeve 202 defines an upwardly opening bore 208 in which is slidably positioned a vent valve means 210. As best shown in FIG. 3, vent valve means 210 is releasably attached to vent sleeve 202 by shear means 212. Shear means 212 is angularly spaced from shear means 204. As shown in FIG. 3, the angular displacement is approximately 45°, but the angle is not at all critical.

An elastomeric, annular gasket 211 is disposed in the upper end of vent valve means 210 above shear means 212. Gasket 211 is held in place by ring 213 which is attached to vent valve means 210 at threaded connection 215.

Upper seal means 214 and lower seal means 216 provide sealing engagement between vent valve means 210 and bore 208 in vent sleeve 202. On the inside of vent valve means 210 is an angularly disposed, annular seat 218. Vent sleeve 202 defines a vent means, such as transverse vent opening 220, therethrough in communication with bore 208 therein. When vent valve means 210 is in the initial position shown in FIG. 2C, vent opening 220 is below lower sealing means 216.

On the inside of the lower end of vent sleeve 202 is an upwardly facing annular shoulder 222 which limits downward movement of vent valve means 210 as is hereinafter described.

Slidably disposed around an enlarged lower end of vent sleeve 202 is a bushing 224. Seal means 226 provides sealing engagement between bushing 224 and vent sleeve 202. The lower end of bushing 224 is adjacent an upwardly facing outer shoulder 228 on vent sleeve 202. Shear means 230, such as a shear pin, provides releasable attachment between bushing 224 and vent sleeve 202.

Attached to bushing 224 is a second or lower plug means 232. Lower plug means 232 includes a body or insert 234 having an upper, inwardly directed portion 236 which is attached to bushing 224 at threaded connection 238. Body or insert 234 is also preferably made of a high-strength plastic material, such as that previously described herein for inserts 152 and 170.

Substantially surrounding and bonded to insert 234 is a closely fitting jacket 240, preferably made of elastomeric material. Jacket 240 has an upper, inwardly directed portion 242 adjacent upper portion 236 of insert 234 and an inwardly directed lower portion 244 adjacent the lower end of insert 234. A substantially longitudinal portion 246 of jacket 240 interconnects upper portion 242 and lower portion 244. Extending angularly upwardly and outwardly from longitudinal portion 246 are a plurality of flexible wipers 248. As will be discussed in greater detail herein, wipers 248 are adapted for sealing engagement with the inside of well casing 16.

Extending transversely through lower plug means 232, and preferably intersecting a longitudinal center line thereof, is a catcher bolt 250. At one end of catcher bolt 250 is a head 252 which is disposed in a hole 254 of jacket 240 and engages an outer surface of insert 234. Opposite head 252 is a threaded end (not shown) of catcher bolt 250 which engages a threaded opening in the opposite side (also not shown) of insert 234.

Referring now to FIG. 11, a third embodiment of the sub-surface release plug assembly is shown and generally designated by the numeral 10''.

At the upper end of the third embodiment is a collet retainer 400 which is substantially similar or identical to collet retainer 116 in the first embodiment. Collet retainer 400 has a chamfered shoulder 402 therein.

The upper end of a collet 404 is disposed in collet retainer 400 such that head portions 406 of a plurality of collet fingers 408 engage shoulder 402 in collet retainer 400.

A releasing sleeve 410 is slidably disposed in collet 404. It will be seen that in the original position of FIG. 11, releasing sleeve 410 keeps head portions 406 of collet fingers 408 engaged with shoulder 402 in collet retainer 400.

A shear means 412, such as a shear pin, is engaged with collet 404 and releasing sleeve 410, thus releasably holding the releasing sleeve in the original position shown in FIG. 11.

The lower end of collet 404 is attached to a collet connector 414 at threaded connection 416.

A first or upper plug means 418, also referred to as a top plug means 418, is attached to collet connector 414 at threaded connection 420. Collet connector 414 extends longitudinally through upper plug means 418.

Upper plug means 418 has a body or insert 422 with an upper inwardly directed portion which forms threaded connection 420 with collet connector 414. Insert 422 is preferably made of a high-strength plastic material, such as that previously described for the first and second embodiments.

A plurality of integrally formed teeth 426 are located on the lower end of insert 422.

As with the previously described embodiments, insert 422 is substantially surrounded by a jacket 428 bonded to the insert and preferably made of elastomeric material. Jacket 428 includes a plurality of wipers 430 adapted for sealingly engaging the inside surface of well casing 16.

The lower end of collet connector 414 is attached to a vent sleeve 432 by a shear means 434, such as a shear pin. Vent sleeve 432 defines a vent means, such as a transverse vent opening 436 therethrough.

Slidably disposed around an enlarged lower end of vent sleeve 432 is a bushing 438. Seal means 440 provides sealing engagement between bushing 448 and vent sleeve 432. The lower end of bushing 438 is adjacent an upwardly facing shoulder 442 on vent sleeve 432. Shear means 444, such as a shear pin, provides releasable attachment between bushing 438 and vent sleeve 432.

A second or lower plug means 446 is connected to bushing 448 at threaded connection 448. Lower plug means 446 includes a body or insert 450 made of a high-strength plastic material, such as that previously described.

Integrally molded on the upper end of insert 450 are a plurality of teeth 452. Teeth 452 are adapted for meshing engagement with teeth 426 on the lower end of insert 422 of upper plug means 418.

Substantially surrounding and bonded to insert 450 is a jacket 454, preferably made of elastomeric material. Jacket 454 is similar to those previously described and has a plurality of flexible wipers 436 which are adapted for sealing engagement with the inside of well casing 16.

A catcher plate 458 is disposed in the lower inner portion of insert 450 and attached thereto at threaded connection 460. Catcher plate 458 could also be integrally molded as part of insert 450 with no threaded connection being necessary. Catcher plate 458 defines a plurality of openings 462 therethrough which assures fluid flow therethrough without allowing any of the mechanical components of the apparatus to pass thereby.

At the lower end of insert 450 are a plurality of integrally molded teeth 464 which are adapted for meshing engagement with similar teeth (not shown) on the upper end of an alternate float shoe or float collar.

Referring again to first embodiment 10, the primary and secondary release means for the lower plug are described in more detail in FIG. 8. In particular, the primary release means comprises a plurality of shear means 204, which are typically shear pins, disposed circumferentially around collet connector 190. Shear means 204 interconnect collet connector 190 and vent sleeve 202. The secondary release area for bottom plug 310 is disposed on the upper end of vent sleeve 202. A secondary release means is provided in that the upper end of vent sleeve 202 is designed and sized such that, should shear means 204 fail to shear at a first predetermined pressure, shear means 204 will rip or tear through vent sleeve 202 adjacent shear means 204 at a second predetermined pressure. Shear means 204 will remain with collet connector 190, thereby not requiring shear means 204 to be sheared during the valve opening.

Likewise, as more fully shown in FIG. 9, the valve means disposed in the cement passageway in lower plug means 232 also has primary and secondary release means. The primary release means comprises a plurality of shear means 230 disposed circumferentially around vent sleeve 202. Shear means 230 engage vent sleeve 202 and shear pin bushing 224. The secondary release means for the valve means in lower plug means 232 comprises a plurality of secondary release areas 320 on the lower end of shear pin bushing 224 adjacent shear means 230. Should shear means 230 fail to shear at a first predetermined pressure, bushing 224 is designed such that shear means 230 will rip or tear through the bushing at a second predetermined pressure, thereby releasing the valve means and opening cement passageway 260.

Also, as more fully shown in FIG. 10, the upper plug means release mechanism also consists of primary and secondary release means. In particular, the primary release means comprises a plurality of shear means 140 disposed circumferentially around releasing collet 126. Shear means 140 engage releasing collet 126 in releasing sleeve 136. Should primary shear means 140 fail to release the plug, the secondary release means for the upper plug means comprises a plurality of collet fingers 130 manufactured so as to have a cross-sectional area 300, or secondary release area 300, sized to permit severing of collet fingers 130 at a second predetermined pressure. In a particularly preferred embodiment, collet fingers 130 are provided with an enlarged space between the fingers at the point where the fingers meet the remaining portion of collet 126. Typically, this enlarged area is created by drilling holes 304 at the point where the fingers meet the collet base.

The sub-surface release plug assembly of third embodiment 10″ could also incorporate this primary and secondary release system.

It will be seen that assembling sub-surface release plug assembly 10 into either a single-plug or two-plug configuration is a simple matter. The upper end of assembly 10 includes the collet mechanism and upper plug means 150 connected thereto. A subassembly including lower plug means 230, bushing 224, vent sleeve 202, vent valve means 210 and collet connector 190 is easily attached and detached from upper plug means 150 by making and breaking the threaded connection 192. Thus, field conversion is easy and no special assembly techniques are required. The sub-surface release plug assemblies of second embodiment 10′ and third embodiment 10″ are similarly assembled.

In each of the embodiments, the primary and secondary release procedures may be predetermined and preset at a manufacturing facility. In particular, the release pressures for the shear means can be controlled by controlling the number, size and position of the shear means and tolerances on the inside diameters of the holes for the shear means and the outside diameter of the shear means. Additionally, the release pressure for the collet fingers may also be predetermined and preset by adjusting the spacing between the fingers such that the fingers have a cross-sectional area that will sever at a predetermined pressure within the drill string. The spacing between the fingers may be uniform or a localized, enlarged face may be provided such as by drilling a hole at the base of the fingers.

OPERATION OF THE INVENTION

Sub-surface release plug assembly 10 or 10' is shown in its original position in FIG. 1. Once it is desired to being the operation for cementing outer casing annulus 38, a ball 256 is dropped and allowed to free fall down drill string 14 in a manner known in the art. Ball 256 may be made of a high strength plastic material, such as that previously described for inserts 152, 170, 234, 422 and 450. Ball 256 comes to rest on seat 218 in vent valve means 210, as shown in FIG. 2C. The inside diameter of gasket 211 is smaller than the diameter of ball 256, but gasket 211 will deflect downwardly and outwardly enough such that ball 256 will pass by the gasket. The inside diameter of ring 213 is only slightly larger than ball 256 and provides upward support for gasket 211. In this way, gasket 211 and ring 213 provide a means for preventing upward movement of ball 256 therepast. This insures that ball 256 remains in position adjacent seat 218 of vent valve means 210.

Pressurizing drill string 14 thus pressurizes central opening 74, and at a predetermined first pressure, shear pin 212 is sheared which allows downward movement of vent valve means 210. Preferably, the pressure is approximately 300 psi. Vent valve means 210 will move downwardly until it comes to rest against shoulder 222 and vent sleeve 202, and it will be seen that upper and lower seal means 214 and 216 will sealingly isolate vent opening 220 from central opening 74.

The lower end of collet 126, collet connector 190, vent sleeve 202 and bushing 224 may be said to form an inner sleeve means 257 extending through upper plug means 150 to which lower plug means 232 is connected. It will be seen that the pressure in central opening 74 in inner sleeve means 257 is not exerted on inside surface 158 of upper plug means 150 or inside surface 178 of second embodiment upper plug means 150'. Finally, it should also be obvious that inner sleeve means 257 also acts as a means for preventing pressure in central opening 74 from being applied to the inside of lower plug means 232 because ball 256 substantially seals against seat 218.

In operation, the incorporation of the primary and secondary release means for the upper end lower plugs and the valve means disposed in the lower plug will insure that the various components are in fact released and cementing operations can continue without necessitating the cost and expense of ceasing cementing operations while a plug that failed to release is removed.

Figure 5:
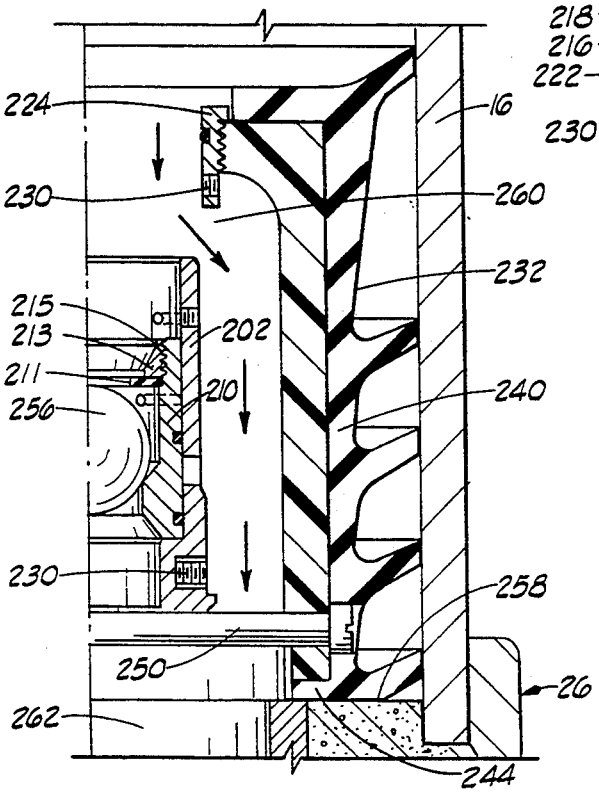
FIG. 5 is a longitudinal cross section showing the lower plug immediately after being released from the top plug.
Figure 5:
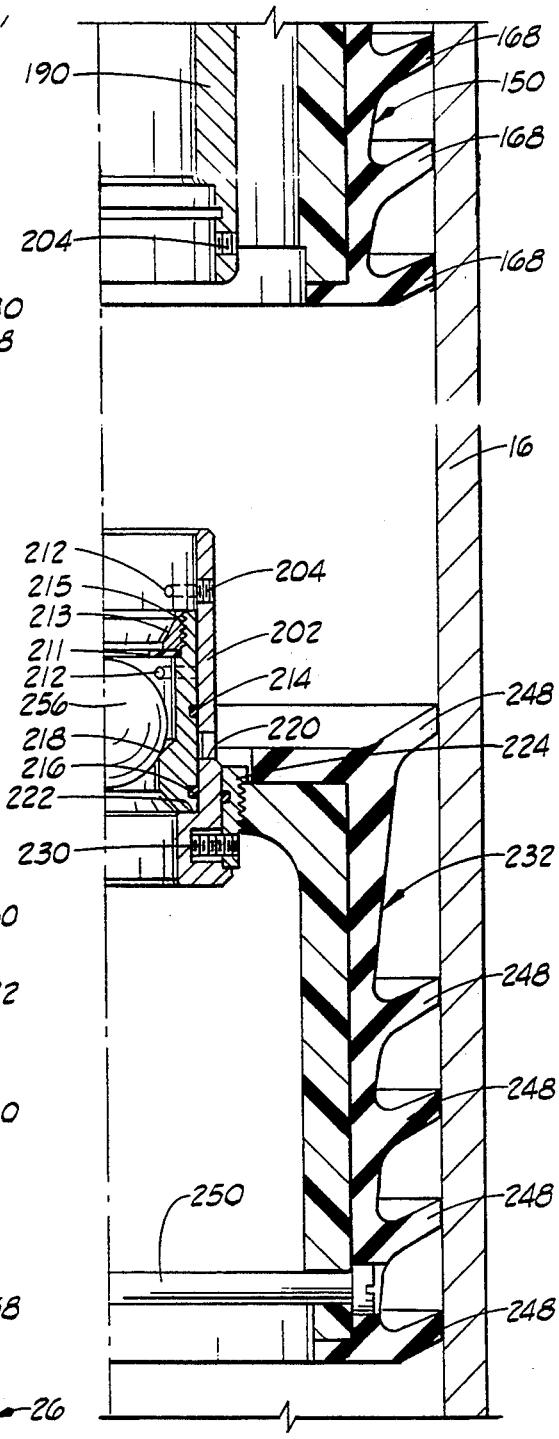

Referring now to FIG. 5, additional pressure may be applied to central opening 74 through drill string 14 such that the primary plug release means for the lower plug, shear means 204, is sheared. Should shear means 204 disposed between collet connector 190 and vent sleeve 202 fail to shear, then the secondary release area 310 formed in the upper end of vent sleeve 202 adjacent shear means 204, will allow the lower plug means to be released. More particularly, if the primary shear means 204 fails to shear at an initial pressure, the secondary release area 210 is actuated since it is designed such that shear means 204 will rip through the upper portion of vent sleeve 202 thereby releasing the lower plug means. In either case, vent sleeve 202 is released from collet connector 290 which, of course, releases lower plug means 232 from upper plug means 150 or 150'. Lower plug means 232 is therefore free to travel downwardly through well casing 16 towards float shoe 26.

Lower plug means 446 in third embodiment plug assembly 10'' is released in a similar manner using ball 256.

Cement pumped from the surface down through drill string 14 will force lower plug means 232 or 446 thus to move downwardly in well casing 16, and wiper rings 248 or 456 will wipe the inside surface of well casing 16 free of the drilling mud or other fluids that were already present therein and sealingly separate the mud from the cement above lower plug means 232 or 446. Eventually, lower plug means 232 or 446 will come to rest against inside, upper surface 258 of float shoe 26. Jacket 240 or 454 will provide sealing engagement of lower plug means 232 or 450 with upper surface 258.

Likewise, after lower plug means 232 has come to rest against float shoe 26, it is necessary to open fluid passageway 260 and thereby allow cement to flow through the float shoe into the annular space adjacent the well casing. When lower plug means 232 reaches float shoe 26, pressure is increased in the drill string until the primary release means, shear means 230, is sheared which thereby allows vent sleeve 202 in vent valve means 210 to fall downwardly within lower plug means 232 until stopped by catcher bolt 250. Alternatively, should the primary release means, shear means 230, fail to shear, the lower end of shear pin bushing 224 is sized and designed such that at a second pressure, shear means 230 will rip through the shear pin bushing material 224 adjacent shear means 230, thereby allowing vent sleeve 202 and vent valve means 210 to fall downwardly within lower plug means 232. Thus, by inclusion of primary and secondary release means, it can be assured that vent sleeve 202 and vent valve means 210 can be downwardly displaced within lower plug 232, thus opening fluid passageway 260 and allowing cement to flow out float shoe 26 and into the annular space between the wellbore and the casing. Thus, a valve means is provided whereby a fluid passageway 260 is formed through lower plug means 232, providing fluid communication between well casing 16 above the lower plug means and an inlet opening 262 in float shoe 26. Referring again to FIG. 1, back pressure valve 34 will be opened by the pressure so that the cement will flow from well casing 16 through lower opening 36 in float shoe 26 and into outer casing annulus 38.

After the desired amount of cement has been pumped through the system, pumping is ceased by the operator. At this point, it is desired to release upper plug means 150, 150' or 418 and pump it downwardly through well casing 16 to displace all of the cement therebelow through flow chute 26 so that no cement will set within well casing 16.

To release upper plug means 150 or 150', a releasing dart or drill pipe plug 264 is pumped down drill string 14 as shown in FIG. 1. As previously described, the upper plug release mechanism also comprises primary and secondary release means. The primary release means comprises shear means 140 disposed around releasing collet 126. Shear means 140 is engaged with releasing sleeve 136 and releasing collet 126. The secondary release means comprises the plurality of collet fingers 130 on collet 126. The primary release means will be actuated when releasing darts 264 is disposed within releasing sleeve 136 and pressures increase sufficient for shearing shear means 140. Should shear means 140 not be sheared at this first release pressure, an increase in pressure will result in tension being applied to collet fingers 130. The secondary release means for the upper plug means comprises the collet fingers having a cross-sectional area such that the collet fingers will fail at a second predetermined pressure above the first pressure at which the shear means would have been expected to fail. Thus, upper plug means 150 or 150' is freed to descend down the drill string in that releasing sleeve 136 and releasing collet 126, less collet fingers 130, are free to fall from the drill string.

The release of upper plug means 418 in third embodiment plug assembly 10'' is accomplished in a similar manner as for the first two embodiments.

Figure 7A:
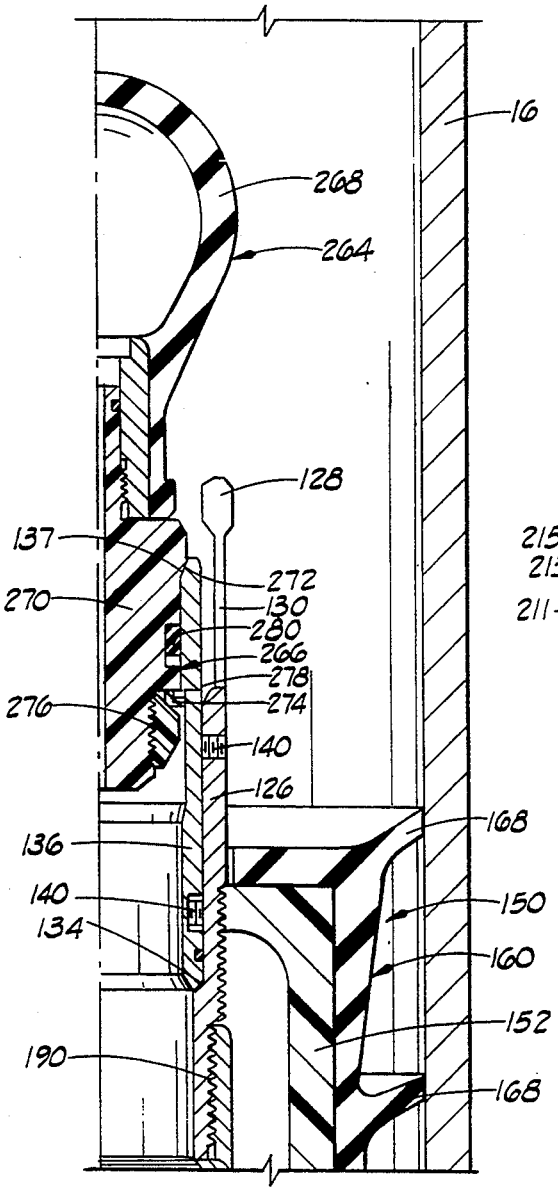

FIG. 7A illustrates a first embodiment releasing dart or drill pipe plug 264 which is designed to sealingly engage the inside surface of drill string 14 and to sealingly close opening 74 in sub-surface release plug assembly 10 or 10'. As shown in FIG. 2B, plugs 274 engages chamfered shoulder 137 in releasing sleeve 136. Drill string 14 is raised to a predetermined pressure which is applied above plug 264 causing a downward force on releasing sleeve 136 sufficient to shear the primary releasing means or the upper plug, namely shear means 140. Releasing sleeve 136 is forced downwardly until it engages chamfered shoulder 134 in collet 126. In this downward most position of releasing sleeve 136, collet fingers 130 and head portions 128 thereof are freed for radially inward movement. Additional pressure in drill string 14 will then cause head portions 128 of collet fingers 130 to disengage from shoulder 124 in collet retainer 126. Thus, a primary releasing means is provided for releasing upper plug means 150 or 150' for subsequential downward movement through well casing 16. Alternatively, as discussed above, collet fingers 130 provide a secondary release means for releasing the upper plug means should shear means 140 fail to shear.

A similar collet mechanism having primary and secondary release means could be used in attaching lower plug means 232 to upper plug means 150 or 150' rather than the shear means 204 already described. In other words, vent sleeve 202 could be constructed with collet fingers thereon. In this embodiment, vent valve means 210 would also provide sealing of the collet mechanism prior to movement thereof by ball 256. Simultaneously with the release of the collet fingers in this embodiment, vent opening 220 would be closed by vent valve means 210.

Figure 7B:
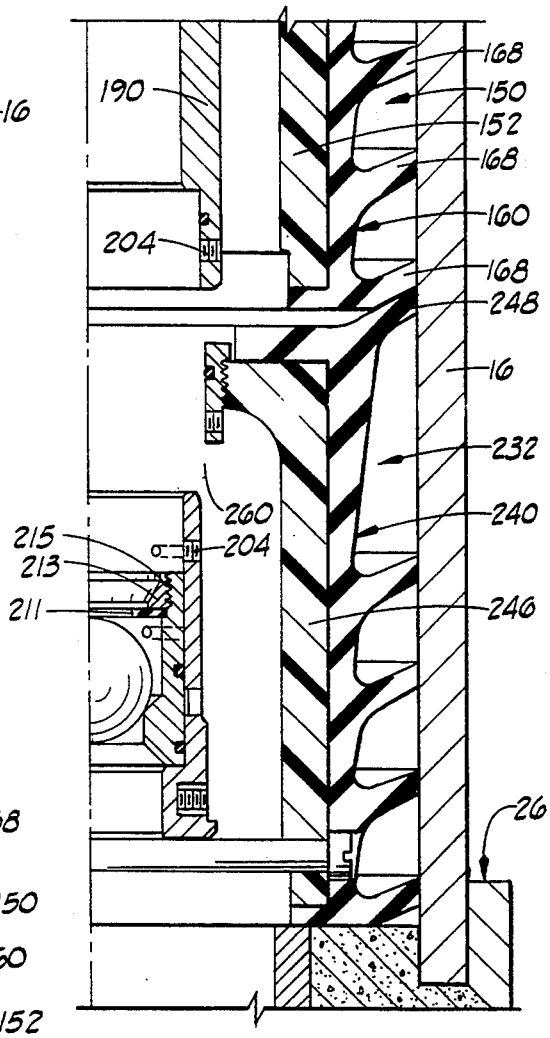

Referring now to FIGS. 7A and 7B, released upper plug means 150 is shown after being moved downwardly through well casing 16 where it is in contact with lower plug means 232. Plug 264 is illustrated with a latching nose 266 connected to an elastomeric body 268. Latching nose 266 includes a mandrel portion 270 having a shoulder 272 thereon which contacts shoulder 137 and releasing sleeve 136. A snap ring 274, disposed between a retainer 276 and mandrel portion 270 is adapted to expand outwardly do that upper movement of plug 264 is prevented by shoulder 278 in releasing sleeve 136. Seal means 280 provides sealing engagement between mandrel portion 270 and releasing sleeve 136. As clearly seen in FIG. 7A, collet fingers 130, and head portions 128 thereof, are completely free.

In the preferred embodiment, latching nose 270 is made of a high strength plastic material, such as that previously described herein. That is, mandrel portion 270 and retainer 276 could be made of this high strength plastic, rather than metallic components as in the prior art.

FIG. 12 illustrates an alternate releasing dart 464. Releasing dart 464 has a body 466 which includes an upper mandrel 468 and a nose 470 attached to one another by a connector 472. Preferably, these components of body 466 are made of a non-metallic material, such as the high strength plastic previously described.

A jacket 474, preferably made of elastomeric material, substantially surrounds and is bonded to mandrel 468. A plurality of wipers 476 extend angularly upwardly and outwardly on jacket 474. Wipers 476 are adapted for sealing engagement with the inside surface of drill string 14. Although not shown, releasing dart 464 may have a similar attaching means thereon, such as latching nose 266 on plug 264.

The operation of third embodiment sub-surface release plug 10'' is substantially identical to those for assemblies 10 and 10'.

As upper plug means 150, 150' or 418 is pumped downwardly through well casing 16, the cement therebelow is displaced outwardly through flow chute 26 and outer casing annulus 38. When the upper plug means reaches the lowermost position, the lowermost wiper 168, 188 or 430 on jacket 160, 180 or 428 thereof sealingly engages the uppermost wiper 248 or 456 on corresponding jacket 240 of lower plug means 232 or 446.

After the cement is set, casing 16 may be immediately pressure tested because of the strength of the high strength plastic materials used in plug assemblies 10, 10' or 10''. Pressure testing up to about 10,000 psi may be carried out without damage to the components of the plug assemblies. Additionally, plug assemblies 10, 10' and 10'' are adapted for use in situations where the well temperature is greater than that previously allowable for plug assemblies using plastic components. With the materials in the present invention, temperatures in the range of about 300° F. to about 400° F., as well as lower temperatures, may be handled with no detrimental effect to plug assemblies 10, 10' or 10''. When compared to prior art plug assemblies which were limited to pressure in the range of about 3,500 psi to about 5,000 psi and with maximum temperatures of about 300° F., it will be seen that the sub-surface release plug assembly of the present invention provides a great improvement over the prior art and meets the long-felt need of using non-metallic components in more severe well conditions.

After testing, the releasing dart or plug, the upper plug means, and the lower plug means are no longer needed. At this point, these components may be drilled out of casing 16 so that the well can be operated in production. The non-metallic components described herein facilitate this drilling operation and allow the use of different drill bits, rather than the conventional tri-cone drill bit. Referring now to FIG. 13, sub-surface release plug assembly 10, 10' or 10'' is shown immediately above float chute 26. Releasing plug 264 or releasing dart 464 is engaged with the top of the plug assembly. For drilling, a tubing or drill string 478 is lowered into casing 16 with a drill bit 480 at the lower end. Standard tri-cone drill bits may be used, and variations in rotary speed and bit weight are not particularly critical because of the non-metallic components of sub-surface release plug assembly 10. This greatly simplifies the drilling operation and reduces the cost and time thereof.

The engagement of teeth 426 with teeth 452 and the engagement of teeth 464 with similar teeth on float shoe 26 in third embodiment plug assembly 10″ prevent rotation of the components during drilling. Such teeth are known in the art and could also be incorporated into first embodiment plug assembly 10 or second embodiment plug assembly 10′.

In addition to standard tri-cone drill bits, because of the plastic construction of the plug assembly of the present invention, alternate types of drill bits may be used which would be impossible for tools constructed substantially of metallic materials, such as cast iron. For example, a polycrystalline diamond compact (PDC) bit may be used. Drill bit 480 in FIG. 13 is illustrated as a PDC bit. Such drill bits have the advantage of having no moving parts which can jam up. Also, if the wellbore itself was drilled with a PDC bit, it is not necessary to replace it with another or different type bit in order to drill out plug assembly 10.

It can be seen, therefore, that the sub-surface release plug of the present invention with non-metallic components is well adapted to carry out the ends and advantages mentioned as well as those inherent therein. While presently preferred embodiments of the invention have been shown for the purposes of this disclosure, numerous changes in the arrangement and construction of parts may be made by those skilled in the art. All such changes are encompassed within the scope and spirit of the appended claims.

What is claimed is:

1. A sub-surface release plug apparatus comprising:

an upper plug releasably attachable to a drill string positionable in a well casing, said plug comprising a body made of a non-metallic material having a compressive strength of at least about 35,000 psi;

a lower plug releasably connected to said upper plug and comprising a body made of said non-metallic material;

a collet interconnecting said upper plug with said drill string;

a releasing sleeve slidably disposed with respect to said collet and adapted for holding said collet in engagement with said drill string when in a first position and adapted for releasing said collet when in a second position; and a releasing plug adapted for engaging said releasing sleeve and moving said releasing sleeve from said first position to said second position in response to a differential pressure across said releasing plug.

2. The apparatus of claim 1 further comprising a plurality of flexible wipers extending outwardly and upwardly from said body of at least one of said upper and lower plugs.

3. The apparatus of claim 2 wherein said wipers are part of an elastomeric jacket substantially surrounding and bonded to said body of at least one of said upper and lower plugs.

4. The apparatus of claim 1 wherein said material is a plastic.

5. The apparatus of claim 4 wherein said plastic is a glass-filled phenolic.

6. The apparatus of claim 5 wherein said glass-filled phenolic has a deflection temperature of at least about 400° F.

7. The apparatus of claim 1 further comprising:

a sleeve shearably interconnecting said upper plug and said lower plug; and a releasing ball engagable with said sleeve and adapted for releasing said lower plug from said upper plug when a differential pressure is applied across said ball.

8. The apparatus of claim 7 wherein said ball is made of a non-metallic material.

9. The apparatus of claim 1 wherein said releasing plug comprises a releasing plug body made of plastic having a compressive strength of at least about 35,000 psi.

10. The apparatus of claim 9 further comprising an elastomeric jacket substantially surrounding and bonded to said releasing plug body, said jacket comprising a plurality of wiper rings extending therefrom.

* * * * *